United States Patent [19]

Sutherland

[11] 4,164,286

[45] Aug. 14, 1979

[54] TAPERED CUP PACKAGE

[75] Inventor: Robert L. Sutherland, Sloatsburg, N.Y.

[73] Assignee: Federal Paper Board Company, Inc., Montvale, N.J.

[21] Appl. No.: 876,667

[22] Filed: Feb. 10, 1978

[51] Int. Cl.[2] ..... B65D 5/04; B65D 85/62

[52] U.S. Cl. ..... 206/434; 229/40

[58] Field of Search ..... 206/434, 423, 161; 229/40

[56] References Cited

U.S. PATENT DOCUMENTS

| | | | |
|---|---|---|---|
| 3,163,322 | 12/1964 | Weiss | 206/161 |
| 3,424,302 | 1/1969 | Ganz | 229/40 |
| 3,828,926 | 8/1974 | Rossi | 206/427 |

*Primary Examiner*—William T. Dixson, Jr.
*Attorney, Agent, or Firm*—Guy A. Greenawalt

[57] ABSTRACT

A package especially adapted for enclosing a double row of product filled cups or tubs of tapered configuration which is characterized by a single blank of foldable sheet material, cut and scored so as to be wrapped about a plurality of the cups arranged in double row, side-by-side relation and forming an open end tubular carton, with the blank having interlocking connecting elements in end panels which form the bottom wall of the carton, and one of said end panels including integral panel portions which are folded into an upstanding keel of triangular cross section disposed in the form of a wedge between the cups in the two rows and maintaining the cups in upright position.

4 Claims, 11 Drawing Figures

FIG. 7
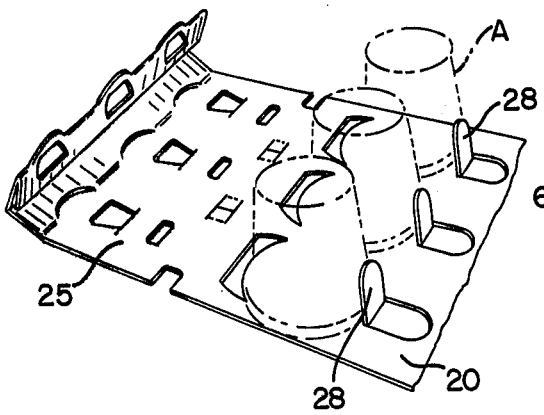
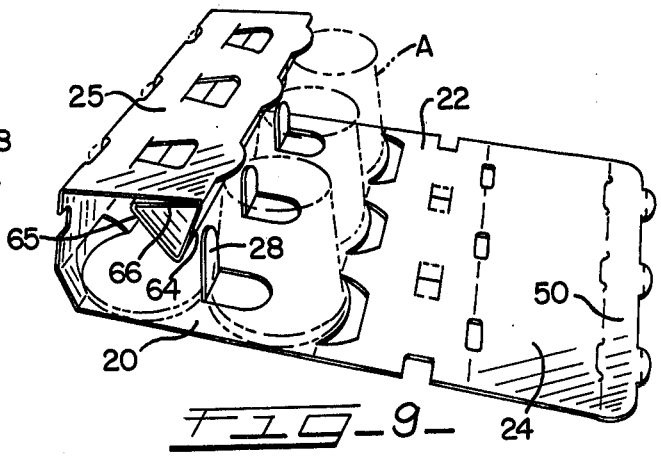
FIG. 9
FIG. 8
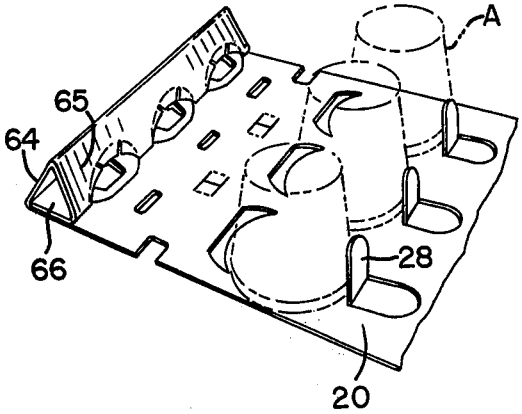
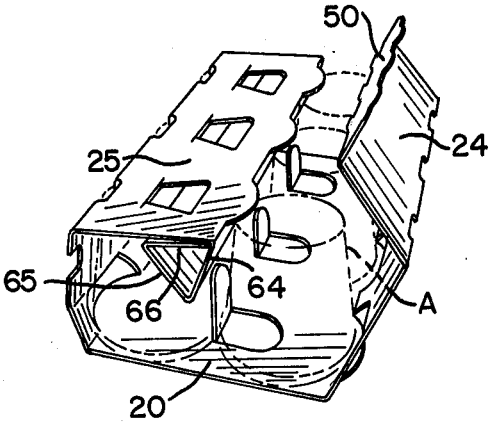
FIG. 10
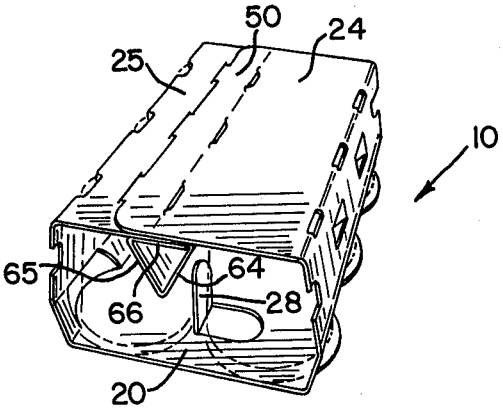
FIG. 11

TAPERED CUP PACKAGE

BACKGROUND OF THE INVENTION

This invention relates to packaging and is more particularly concerned with improvements in the packaging of an assembly or group of articles having the form of cups with tapered sidewalls which are adapted to be arranged in double row relation and enclosed in a wrap-around type blank of foldable sheet material so as to form a multi-unit package.

In the marketing of a number of products, for example, dairy products, individual consumer units or portions are frequently prepared for distribution by placing the same in cup-shaped containers having inwardly and downwardly tapered sidewalls, and closing the cups with lid type closures which provide a flat top surface. In many cases, larger package units are then prepared by assembling a plurality of the cups into a group and packaging the group. One form of group packaging, which has been employed originally in the multi-unit packaging of canned beverages and similar products, has been employed with some degree of success in the multi-unit packaging of products in cups, but cups of the tapered sidewall configuration have presented problems, largely because the resultant package has not been of a character which lends itself to satisfactory stacking on a shelf for display and/or self service. The cups are tilted in forming a tight wrap which is desirable to retain the cups in the package and an upwardly bowed top surface results which prevents stable piling of the packages upon each other.

It is a general object of the invention to provide a method and a means for forming an improved multi-unit package of a plurality of articles which have the general shape of a cup with a tapered sidewall and which are adapted to be arranged in double row relation and a group thereof enclosed in a cut and creased blank of foldable wrapping material.

It is a more specific object of the invention to provide a packaging arrangement which is especially adapted for enclosing in tightly wrapped relation a plurality of articles, having the general form of a cup with tapered sidewalls and which are arranged in double row, side-by-side relation, in a cut and scored blank of foldable sheet material with provisions for retaining the articles in upright position and restraining them against movement out of the open ended carton which is formed by wrapping the blank about the articles.

A further object of the invention is to provide a packaging arrangement for a group of cup shaped articles which have tapered sidewalls and which are arranged in double row transversely aligned relation and enclosed in a carton forming blank of foldable sheet material, which blank is cut and scored so as to be wrapped about the group of articles and secured with provisions for separating the cups in the rows and positioning them in upright relation so as to form a flat top carton surface.

The invention which is disclosed and claimed herein comprises a packaging arrangement in which a plurality of articles having the general shape of cups with upwardly and outwardly tapered sidewalls and arranged in a double row are enclosed in a carton formed by wrapping about the articles a blank of foldable sheet material which is cut and scored to provide in the erected carton, connected top, side and bottom walls and a center article separator structure extending between the bottom portions of the articles in the rows with upwardly converging walls which separate the bottom portions of the articles and hold the articles in upright position.

The foregoing and other objects and advantages of the invention will become more apparent from a consideration of the accompanying description of the preferred form thereof which is set forth therein by way of example and shown in the accompanying drawings wherein like reference numerals indicate corresponding parts throughout:

BRIEF DESCRIPTION OF THE DRAWINGS

FIGS. 7, 8, 9, 10 and 11 illustrate successive steps in wrapping the blank of FIG. 6 about a group of articles, the steps being shown with the articles being in an inverted position on the top wall forming panel in all of the views.

DESCRIPTION OF THE PREFERRED EMBODIMENTS OF THE INVENTION

Figure 2:
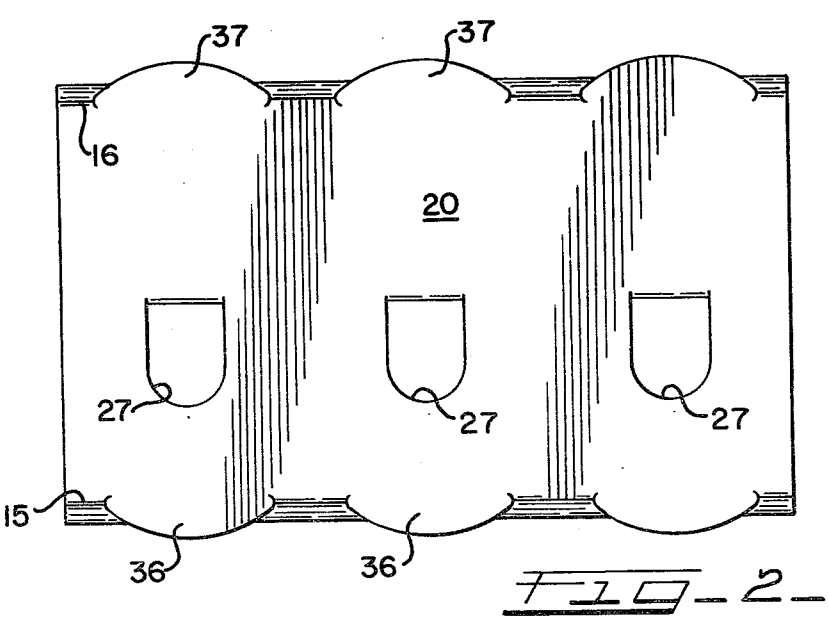
FIG. 2 is a top plan view of the carton of FIG. 1.
Figure 1:
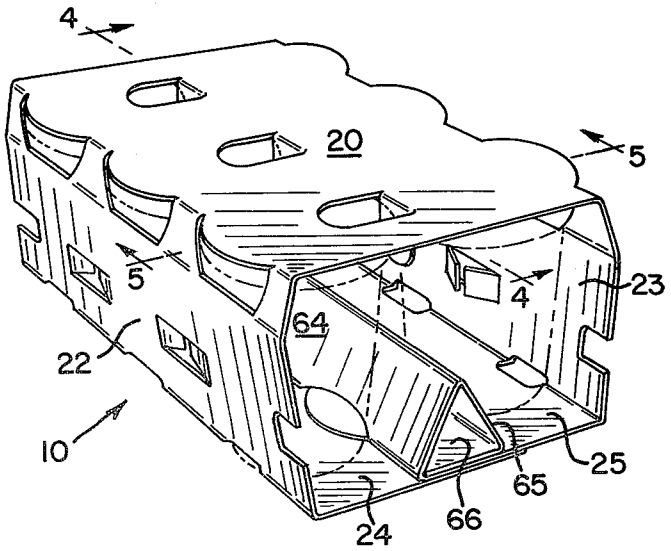
FIG. 1 is a perspective view of a package forming carton which embodies the principles of the invention, with articles shown therein in phantom line.
Figures 3, 5, 6:
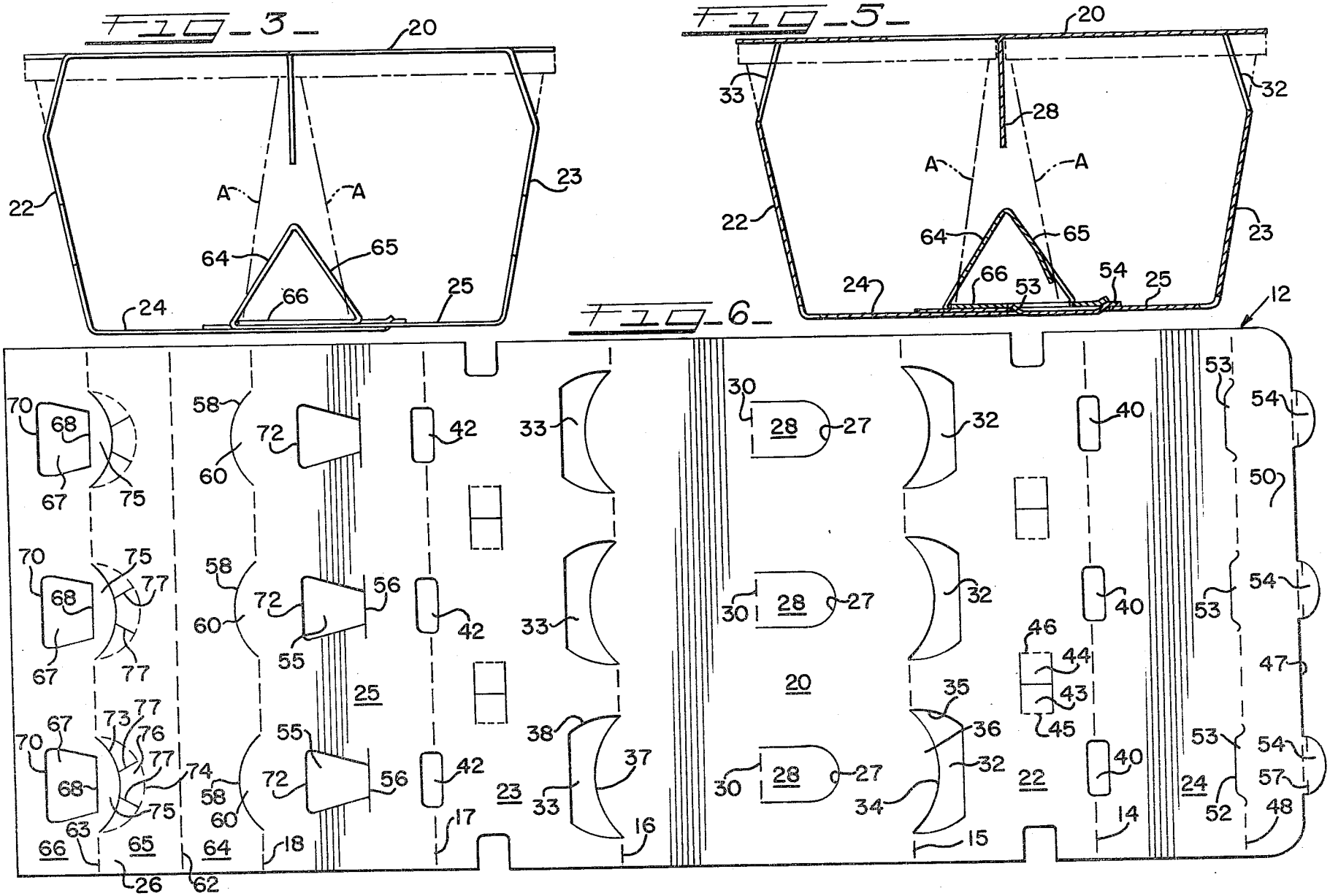
FIG. 3 is an end view of the carton of FIG. 1.
FIG. 5 is a longitudinal section taken on the line 5—5 of FIG. 1.
FIG. 6 is a plan view of a blank of foldable sheet material which is cut and scored preparatory to forming a package, the inside face of the blank being shown.

Referring first to FIGS. 1 and 6, there is illustrated a preferred form of a package forming carton 10 and a blank 12 of paperboard or similar foldable sheet material, of suitable weight, which blank is cut and scored so as to provide the desired elements for enclosing a plurality of cup shaped articles A and retaining them in tight wrapped relation therein, thereby providing a multi-unit consumer package. In the form illustrated, the carton is designed to enclose two rows of three articles arranged in transversely aligned pairs with the articles having sidewalls tapered upwardly and outwardly and closed by flat top lids. A larger or smaller number of the articles may be packaged in the same manner.

The blank 12, which is generally rectangular, is divided by longitudinally spaced, transverse, hinge forming crease or score lines 14, 15, 16, 17 and 18 into a center top wall forming panel 20, adjoining sidewall forming panels 22, 23, a pair of bottom wall forming panels 24, 25, which adjoin the sidewall forming panels, and a row separating panel structure, or assembly 26, the latter constituting the one end portion of the blank 12, while the one bottom wall forming panel 24 constitutes the other end portion of the blank.

The top wall forming panel 20 which extends between the score lines 15 and 16 has cut therein on U-shaped lines three transversely spaced article separator tabs 28 each adapted to hinge into a plane normal to the plane of the panel 20 on aligned transversely extending, hinge forming scores 30, the latter being on a line coinciding with the transverse center line of the panel. The article separator tabs 28 are spaced transversely of the blank according to the lid dimension or spacing of the cups or tubs A in the rows which the blank is designed to be wrapped about. The edge defining score lines 15 and 16 are spaced apart a distance somewhat less than the combined diametrical dimension of the lids on a transversely aligned pair of the cups A and top retaining apertures or openings 32 and 33 are cut along the score lines 15 and 16, respectively, which extend into the sidewall panels 22 and 23. These openings are formed in longitudinal alignment with the separator tabs 28, the transverse spacing being determined in the same manner according to the top dimensions of the cups. Each of the openings 32 is formed by cutting on the lines 34 and 35. The line 34 has the form of a segment of a circle with the ends intersecting or interrupting the score line 15 and forming a semi-circular edge tab 36 which extends from the score line 15 toward the end of the blank and which remains in the plane of the panel 20 when the carton is set up with the sidewall panel 22 being hinged on the line 15. The openings 33, which are spaced along the score line 16, are each formed in a similar manner by cutting on the lines 37 and 38 so as to leave the tabs 40 integral with the panel 20 and extending outboard of the score line 16 while the openings 33 extend a short distance into the sidewall panel 23. The size of the openings 32 and 33 and the radius of the cutting line segments 34 and 37 will depend upon the dimensions of the cups which are to be enclosed, the cutting line radius corresponding approximately to the radius of the cup lids. The score lines 14 and 17 which define the bottom edges or hinge lines for the sidewall forming panels 22 and 23 are interrupted by small, generally rectangular cup retaining openings 40 and 42 which are spaced transversely of the blank according to the spacing of the cups and which are aligned with the openings 32 and 33 in the direction lengthwise of the blank. The openings 40 and 42 are of dimensions sufficient to receive bottom edge portions of the cups and to restrain the cups against movement in the direction transversely of the blank when the latter is tightly wrapped about the cups.

The sidewall forming panels 22 and 23 have cut therein, in the areas between the transverse score lines which define the panel edges, pairs of small tab members 43, 44 which are adapted to hinge on spaced score lines 45, 46. The pairs of tab members 43, 44 are spaced transversely of the blank according to the spacing of the cups and disposed so as to swing open between adjoining cups, and permit lug members on transport conveyors to engage therein and control the advance of the package during certain packaging operations.

The bottom wall forming panel 24 at the one end of the blank extends from the transverse score line 14 to the blank end edge 47 and a transverse score line 48, which is parallel with score line 14 and spaced inwardly of the end edge 47 a predetermined distance, defines, with the edge 47, a narrow locking or latching panel 50 in the marginal portion of the end panel 24. The score line 48 is interrupted by transversely spaced, generally C-shaped cuts 52 with short reversely directed end portions, which form primary locking elements or tabs 52, the latter being integral with and in the plane of the panel 50. The C-shaped cuts 53 open in the direction of the end edge 47 of the blank and are spaced transversely of the blank in alignment with the cup egde receiving openings 32 and 40. At the opposite side of the panel 50 secondary locking or latching elements 54 of generally half moon shape project from the blank edge 47 in transversely spaced relation, with the spacing corresponding to the spacing of the primary locking tabs 53, so that the locking and latching elements 53 and 54 are in paired relation and oppositely disposed on the opposite edges of the panel 50.

The bottom wall forming panel 25 at the other end of the blank is cut so as to provide a plurality of locking and latching openings or apertures 55 of generally truncated triangular shape which constitute female locking elements for receiving the male locking and latching elements 53 and 54 carried on the panel 50 at the opposite end of the blank. The one base forming cutting line 56 which defines the shortest edge of each of the openings 55 is extended at each end, as shown, so as to facilitate entry of the secondary latch elements 54, the latter being somewhat wider than the opening adjacent the line or edge 56 and being slit at 57 on opposite side edges for the same purposes. The bottom wall forming panel 25 is separated from the separator panel structure 26, which is designed to provide a separating keel between the two rows of cups, by transverse score line 18, and this score line is interrupted by transversely spaced cutting lines 58 which are in the form of segments of a circle, similar to the cutting lines 37, but which have a radius corresponding approximately to the radius of the bottom face of the cups, resulting in tab elements 60 which are integral with the panel 25 and remain in the plane thereof when the package is formed.

Figure 4:
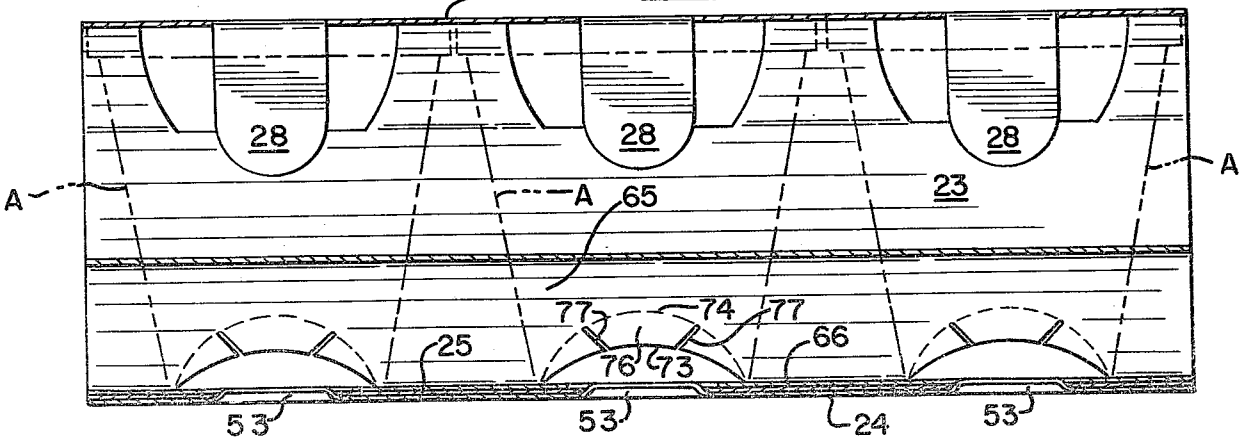
FIG. 4 is a cross sectional view taken on the line 4—4 of FIG. 1.

The end panel 26 is cut and scored so as to form, in the finished package, a wedge keel between the cups in the two rows thereof, for holding the cups in upright position and cooperating with the openings 40 and 42 in restraining the cups against endwise movement in the tight wrapped package. The panel 26 is subdivided by longitudinally spaced, parallel, transverse, hinge forming score lines 62 and 63, into three panels 64, 65 and 66, of equal width, and extending transversely of the blank, so as to enable the panels 64, 65 and 66, of equal width, and extending transversely of the blank, so as to enable the panels 64, 65 and 66 to be folded on the hinge lines 18, 62 and 63 into a keel formation or rib of triangular cross section which is upstanding from the plane of the bottom wall of the finished package (FIGS. 1, 3, 4, and 5). The endmost panel 66 has cut therein transversely spaced truncated triangular shaped apertures or openings 67 which are aligned longitudinally of the blank with the latch openings 55 in the panel 25. The openings 67 have a dimension in the direction transversely of the blank which is somewhat greater than the corresponding dimension of the openings 55. The innermost cutting lines 68 which define the one transverse edge of the openings 67 interrupt the transverse score line 63 and are longer than the edge defining portions of the cutting lines 56 while the cutting lines 70 which define the outermost edges of the openings 67 are longer than the corresponding edges 72 of the openings 55 and the spacing between the edge lines 68 and 70 is substantially less than the corresponding distance between the edge defining lines 56 and 72. The intermediate keel forming panel 65 is cut on the lines 73 and scored on the lines 74 which cutting and scoring lines are in paired relation with each pair thereof spaced along the score line 63 and aligned in the longitudinal direction of the blank with the openings 67, the cutting lines 58 and the openings 55. The cutting lines 73 are in the form of a segment of a circle, or a "C", with the open side in the direction of the end of the blank and are cut on the same radius as the cutting lines 58. The cutting lines 73 bow into the panel 65 with their ends terminating at the score line 63 so as to define tab formations 75 in the plane of the panel 66 and extending from the score line 63 in the direction of panel 65. The score lines 74 are of like form but of a shorter radius than cutting lines 73 and are offset relative to the associated cutting lines 73 with the ends thereof terminating at intersecting points with the ends of the cutting lines 73, so as to form between the lines 73 and 74 crescent shaped areas 76 which are slit on radial lines 77 to facilitate bending of the resulting segments when bottom edge portions of the cups are engaged in the openings which result from the folding of panels 64 and 65 about the hinge line 63 into keel forming position (FIGS. 4 and 5). The width of the panels 64, 65 and 66 will be determined by the taper in the sidewalls of the cups. In order to position the cups with the vertical axis approximately normal to the plane of the bottom wall so that the flat tops are in a common plane and a flat top surface is obtained on the package, with bottom edge portions of the cups locked in openings in the upwardly inclined keel panels 64 and 65, the panel 66 will have an effective width, when in position (FIG. 5), which exceeds the difference in the diameters of the top and bottom of the cups. The cup lids may, of course, have depressed areas and still present top wall panel contacting areas which result in a flat surface on the top of the package.

Referring to FIGS. 7 to 11, there is illustrated a sequence of folding steps for assembling the blank 12 and a group of the articles A and folding and securing the blank 12 about the grouped or assembled articles. For better clarity in illustration, the cups A are shown in an inverted position on the top wall forming panel 20 of the blank, with the blank being folded and secured so that the completed package, as shown in FIG. 11, is in inverted position. It is contemplated that, in machinery production of the package, the blank will be assembled with the cups or other articles in right-side-up position and the panels folded about the sides and bottom of the assembled cups, with the locking elements in the bottom panels being interengaged beneath the assembly. In the illustrated arrangement, the two rows of inverted cups are positioned on the top wall panel 20 (FIGS. 7, 8 and 9) with the separator tabs 28 upstanding between the pairs of cups. The keel forming panels 66, 65 and 64 are swung about the hinge lines 63, 62 and 18 to the position shown in FIG. 8 where the panel 66 lies on the outboard portion of the bottom wall forming panel 25. The bottom wall panel 25 and the adjoining sidewall panel are swung on the hinge lines 17 and 16 to the position shown in FIG. 9 which wedges the keel assembly 26 between the bottom portions of the cups in the two rows with bottom edge portions extending in locked relation in the openings in the panels 64 and 65 (FIG. 5). The panels 22 and 24 are swung about the hinge lines 15 and 14 which brings the locking panel into position for engaging the male locking and latching elements 53 and 54 in the cooperating female locking apertures 55 to complete the package. The locking and latch elements may be interengaged as shown in U.S. Pat. No. Re. 26,750. The keel arrangement, with the three integrally connected panels 64, 65 and 66 which are anchored to the bottom wall panel 25, forms a rib like structure which is wedged between the bottom portions of the cups in the two rows thereof and cooperates with the other edge retaining apertures in locking the cups in the desired position without interference with the interengaging of the elements 53 and 54 in the apertures 55 in locking the two bottom wall panels 24 and 25. The tabs 60 and 75 extend beneath the bottom faces of the cups which insures that the panels 64 and 66 remain in place and form with the panel 65 a rigid bottom wall reinforcement while enabling the formation of a glueless carton and a package which is stable and readily stacked for display and handling.

I claim:

1. A package comprising a double row of articles having the form of cups with upwardly and outwardly tapered sidewalls, said articles being arranged in transversely aligned pairs, and a wrapper formed from a blank of paperboard or similar foldable sheet material enclosing said articles so as to provide a level top wall forming panel, sidewall panels depending from opposite outboard edges of said top wall panel, and a pair of bottom wall forming panels extending in integrally hinged relation inwardly from the bottom edges of said sidewall panels, with inboard portions overlying each other and interengaging locking elements in said overlying portions, said sidewall panels having apertures at the top edges for engaging therein portions of top edges of the articles so as to restrain movement of the top portions of said articles relative to said sidewall panels, and a separator structure upstanding from said bottom wall forming panels which extends between the rows of articles, which separator structure comprises integrally hinged panels of substantial width extending from an inboard edge of one of said pair of bottom wall forming panels, said separator panels being folded into wedge forming relation with the terminal panel thereof being disposed in overlying relation with the inboard marginal portion of the other one of said bottom wall forming panels and adjoining panels in upstanding relation from opposite edges thereof and having apertures in which bottom portions of said articles engage with the bottom portions a sufficient distance apart to position the vertical axes of the articles in substantially upright relation while top edge portions of the articles in the rows are positioned in closely adjacent relation above said bottom separator structure, said interengaging locking elements in said overlying portions of said bottom panels comprising apertures in the innermost panel portion and locking and latching tabs in the outermost panel portion which are engaged in said apertures, and said terminal panel of said separator structure having portions overlying at least in part said apertures and the locking and latching tabs therein.

2. A package as set forth in claim 1 wherein said separator panels are disposed in said wedge forming relation with the terminal panel in face engagement with a portion of the associated bottom wall panel and with upstanding panels inclined upwardly and converging to a hinged connection at a substantial distance above said bottom wall panels which upstanding panels have oppositely disposed aperture means for engaging bottom edge portions of a pair of said articles.

3. A package as set forth in claim 1 wherein said terminal panel which is disposed above said overlying portions of said bottom wall forming panels has spaced apertures therein which are substantially aligned vertically with the locking apertures in said bottom wall forming panel.

4. A blank of paperboard or similar foldable sheet material for wrapping about a double row of cup shaped articles which are characterized by upwardly and outwardly tapered sidewalls, said blank being generally rectangular and divided by parallel, longitudinally spaced transverse crease lines into a plurality of wall forming panels, one of said panels which is intermediate the ends of said blank being a top wall forming panel of sufficient dimension longitudinally of the blank to extend across the tops of a pair of said articles which are disposed in side-by-side relation, said one panel being separated by transverse score lines from adjoining sidewall forming panels which have a dimension longitudinally of the blank corresponding to the axial depth of the articles, said separating score lines being interrupted by openings spaced transversely of the blank for receiving top edge portions of the articles, said sidewall forming panels being separated from adjoining endmost panels by transverse score lines which are interrupted by transversely spaced openings for receiving bottom edge portions of said articles, the endmost panels in said blank having portions with interengaging locking elements for securing the same in bottom wall forming relation when said portions are overlapped upon folding the blank about the articles, and the endmost panel at one end of said blank being subdivided by parallel, longitudinally spaced transverse score lines to provide on the end thereof three integrally connected panels of substantial dimension in the direction longitudinally of the blank which are adapted to be hinged upon each other to form a wedge arrangement of triangular cross section between the rows of articles with the endmost panel thereof disposed in overlying relation on the portions of said bottom wall forming panels which are overlapped and which have said interengaging locking elements and said endmost panel having a cross sectional dimension sufficient to space the adjoining wedge forming panels which are disposed vertically so as to hold the bottom edges of oppositely disposed articles in the rows in transversely spaced relation whereby the articles are in upright position with their axes extending substantially upright.

* * * * *